United States Patent [19]

Schiffmacher et al.

[11] Patent Number: 4,948,278

[45] Date of Patent: Aug. 14, 1990

[54] REPLACEABLE RIBBON GUIDE FOR DOT MATRIX PRINTERS

[75] Inventors: William M. Schiffmacher, Eagle Vail, Colo.; B. Franklin Griffin, Jr., Alexandria, Va.

[73] Assignee: Aspen Ribbons, Inc., Lafayette, Colo.

[21] Appl. No.: 407,758

[22] Filed: Sep. 15, 1989

[51] Int. Cl.[5] ..... B41J 35/04

[52] U.S. Cl. ..... 400/248; 400/211

[58] Field of Search ..... 400/211, 212, 216.1–216.5, 400/247, 248, 250

[56] References Cited

U.S. PATENT DOCUMENTS 4,568,209 2/1986 Zerillo ..... 400/216.1
4,874,262 10/1989 Yokoi et al. ..... 400/216.1

FOREIGN PATENT DOCUMENTS 0242870 10/1986 Japan ..... 400/216

OTHER PUBLICATIONS

Xerox Disclosure Journal, vol. 4, #3, May/Jun. 79, Multi-Track Ribbon Lift Control.

*Primary Examiner*—Edgar S. Burr
*Assistant Examiner*—Ren Yan
*Attorney, Agent, or Firm*—Gary D. Fields

[57] ABSTRACT

A ribbon guide for use with a dot matrix printer having a printhead traversable along a path parallel to a printing platen and which includes means for selectively shifting the ribbon guide to one of several positions. The ribbon guide includes a central body portion which pivotally mounts on pivot pins to the printhead. A pair of faceted ring segments are formed on the central body portion for supporting the ribbon as it passes through the ribbon guide and over an opening in the central body portion adjacent to the printhead. The central body portion is also formed with a pair of support members at opposite ends each having a faceted outer surface for contact with the printing paper. In addition, the support members include a slit for releasably securing an endless loop of ribbon to the ribbon guide to allow field replacement of a ribbon guide. In use the ribbon guide can be selectively shifted to form selected segments of the ribbon into flat segments generally perpendicular to the printhead for forming less distorted print.

16 Claims, 3 Drawing Sheets

REPLACEABLE RIBBON GUIDE FOR DOT MATRIX PRINTERS

TECHNICAL FIELD

The present invention relates to a printer ribbon guide and in particular to a ribbon guide for dot matrix printers.

BACKGROUND ART

In general, dot matrix printers are constructed with a moveable printhead. The printhead includes a nosepiece with a matrix of printhead pins which are actuated at timed intervals to print. The nosepiece operates in combination with a loop of inked ribbon to imprint paper which is fed across a printing platen. For high speed and multi color printing a gear driven ribbon guide is utilized to shift the ribbon to a selected position with respect to the nosepiece of the printhead. This permits parallel stripes or segments of different colors along the width of the ribbon to be selectively aligned with the nosepiece for multi color printing. Alternately, if the ribbon is of a solid color the ribbon guide permits bands along the entire width of the ribbon rather than just a single band to be utilized in printing. The ink supply of the entire ribbon can thus be depleted. The coordination and timing of the printhead, nosepiece, ribbon and ribbon guide are controlled by a microcomputer.

Typically, the ribbon guide is pivotally mounted to the printhead and is coupled through gear teeth to a motor driven gear. Rotation of the gear through a small angle rotates the ribbon guide through a corresponding angle and displaces the ribbon with respect to the printhead to one of a selected number of positions.

The ribbon guide is typically formed with an opening adjacent to the printhead and the ribbon is threaded through the ribbon guide and across this opening. Support segments of the ribbon guide formed on either side of the opening adjacent to the printhead, support the ribbon for contact with the printhead and the printing paper.

U.S. Pat. No. 4,568,209 to Zerillo discloses a ribbon cartridge assembly for dot matrix printers having such a ribbon guide.

One problem with this type of ribbon guide is that the ribbon is generally formed as a closed or endless loop and must be threaded through the ribbon guide upon initial manufacture of the ribbon cartridge. Accordingly, there is no provisions for field replacement of just the ribbon guide portion of the ribbon cartridge as might be required with a worn ribbon guide.

Another problem with this type of ribbon guide is that the action of the ribbon guide may distort the printing. In particular, the curved outer surface of the ribbon guide as well as the curved support segments for the ribbon, press the paper into a corresponding curved shape. Consequently the printing may be slightly distorted by interaction with the curvature of the paper.

The present invention is directed to a ribbon guide that overcomes these limitations. The ribbon guide of the invention is constructed with open slits for releasably securing the ribbon to the ribbon guide. This allows a ribbon guide to be mounted to or removed from a printhead and a ribbon secured to or released from a ribbon guide without breaking the closed loop of ribbon. A worn ribbon guide can thus be replaced in the field or a ribbon cartridge carrying either a closed loop or double ended ribbon may be replaced without removing the ribbon guide.

Additionally, the ribbon guide of the present invention is constructed with faceted rather than curved support segments for the ribbon and a faceted outer surface for contact with the paper. The flat faceted segments help maintain the ribbon and paper parallel to the printing platen so that the printhead pins may strike the print at a right angle to the ribbon and paper.

DISCLOSURE OF THE INVENTION

In accordance with the present invention a replaceable ribbon guide for dot matrix printers is provided. The ribbon guide is intended for use with a dot matrix printer having a printhead traversable along a printing platen and which includes means for selectively rotating the ribbon guide to one of a selected position.

The ribbon guide includes a central body portion that pivotally mounts to the printhead and through which a ribbon may be threaded and supported for supplying ink to the printhead. A pair of faceted ring segments are formed on the central body portion for supporting the ribbon as it passes through the ribbon guide and over an opening in the central body adjacent to the printing pins of the printhead.

The central body portion also includes a pair of support members having faceted outer surfaces that correspond in shape to the faceted ring segments for the ribbon. In use the support members press the printing paper against the fixed platen. Each support member is formed with a slit through which the ribbon can be passed for releasably securing the ribbon to the inside surface of the support member.

Rotation of the ribbon guide through a small angle to a selected position displaces the ribbon with respect to the printhead and aligns a selected segment along the width of the ribbon with the printhead pins. The faceted construction of the ring segments and support members form the ribbon and paper into flat rather than curved segments and provide for less distorted printing. Additionally the slited construction of the support members allows a ribbon to be easily removed from a ribbon guide and the ribbon field threaded to a new ribbon guide without breaking an endless loop of ribbon.

Additional advantages of this invention will become apparent from the description which follows, taken in conjunction with the accompanying drawings.

BEST MODE FOR CARRYING OUT THE INVENTION

Figure 1:
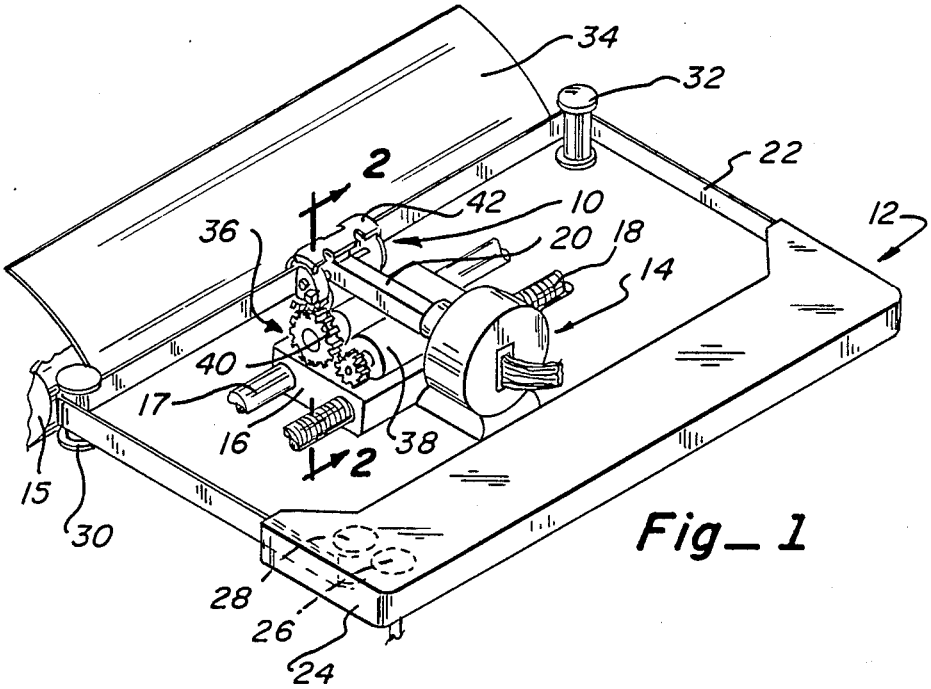
FIG. 1 is a reduced perspective view, with parts removed, of a dot matrix printer having a ribbon guide constructed in accordance with a preferred embodiment of the invention.
Figure 2:
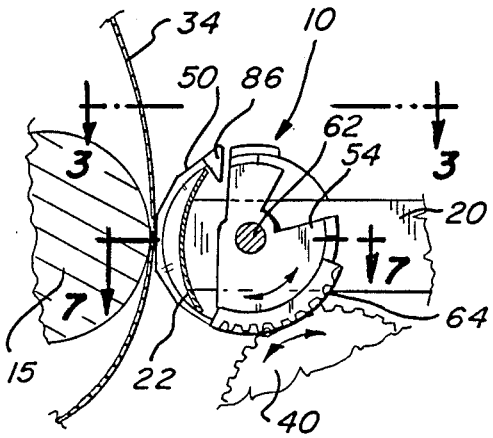
FIG. 2 is a vertical section taken along vertical line 2—2 of FIG. 1 showing a side elevational view of a ribbon guide constructed in accordance with a preferred embodiment of the invention.
Figure 3:
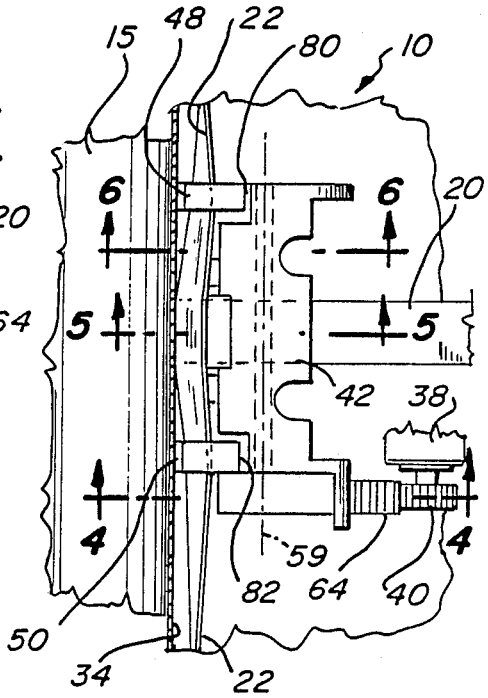
FIG. 3 is a horizontal section taken along section line 3—3 of FIG. 2 showing a plan view of the ribbon guide and a portion of the dot matrix printer.
Figure 4:
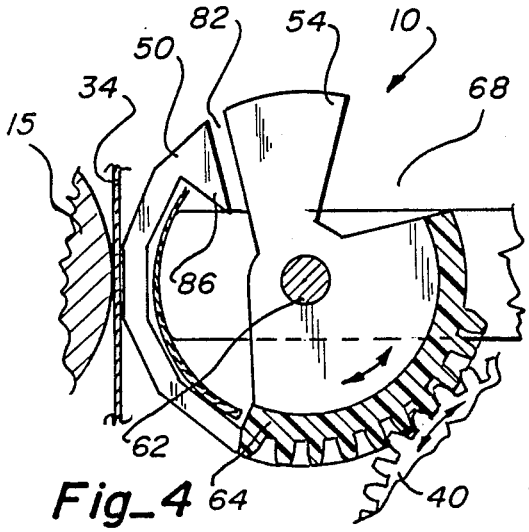
FIG. 4 is an enlarged vertical cross sectional view taken along section line 4—4 of FIG. 3.
Figure 8:
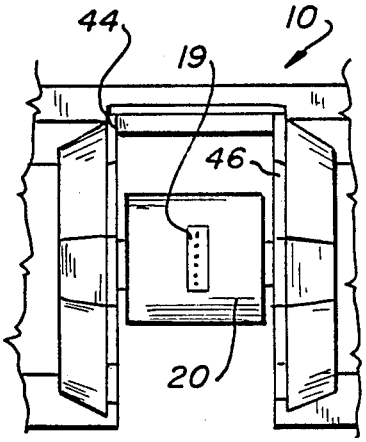
FIG. 8 is an enlarged vertical section taken along section line 8—8 of FIG. 5.
Figure 5:
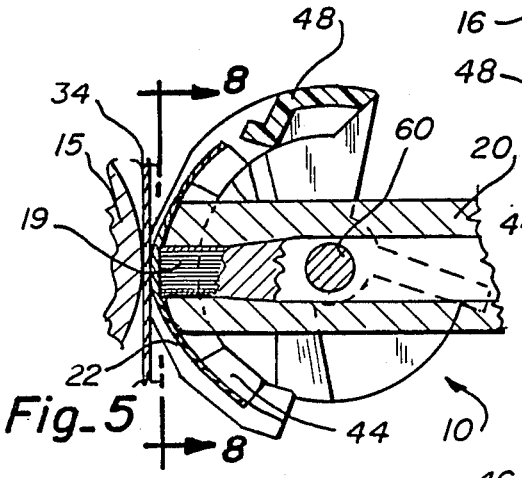
FIG. 5 is an enlarged vertical cross sectional view taken along section line 5—5 of FIG. 3.
Figure 6:
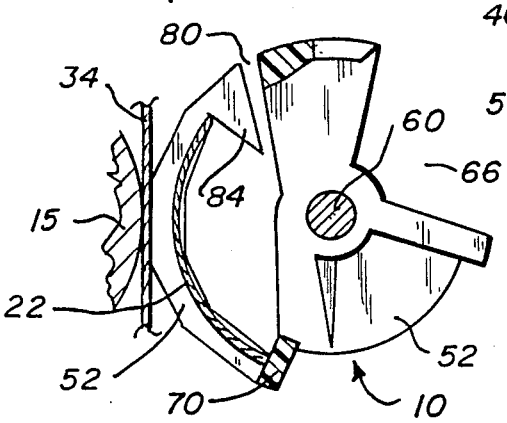
FIG. 6 is an enlarged vertical cross sectional view taken along section line 6—6 of FIG. 3.

Referring now to FIG. 1, a replaceable ribbon guide 10 is shown which is intended for use with a high speed dot matrix printer 12. The dot matrix printer 12 includes a printhead 14 that is traversable along a path parallel to a stationary or rotatable printing platen 15. The printhead 14 is mounted on a carriage 16 for movement along a frame 17 by rotatable threaded shaft 18 and includes a closely spaced array or matrix of printhead pins 9 (FIG. 8). The printhead pins 19 are contained in a nosepiece 20 of the printer 12 and project from the end of the nosepiece 20. The nosepiece 20 is generally rectangular in cross section and as shown in FIG. 8 has a rectangular end from which the printhead pins 19 project.

The printer 12 also includes an endless loop of ribbon 22 packed in a ribbon cartridge 24. Drive rollers 26, 28 draw the loop of ribbon 22 through the printer 12 and back into the ribbon cartridge 24. Roller guides 30, 32 maintain the ribbon 22 in a position generally parallel to the printing platen 15. A web of paper 34 is continuously fed through the printer 12 between the ribbon 22 and the printing platen 15.

For printing, the printhead 14 is traversed along the printing platen 15 by a suitable drive means (not shown) and the printhead pins 19 are actuated to print through the ribbon 22 onto the paper 34. The timing and actuation of the printhead 14 and printhead pins 19 as well as the ribbon 22 and paper 34, are coordinated by computer (not shown).

The ribbon 22 may be of a solid color or may include stripes of different colors, across the width of the ribbon, as is conventional for multicolor printing. For multicolor printing the ribbon 22 is shifted by the ribbon guide 10 to align a selected segment along the width of the ribbon with the nosepiece 20 and printhead pins 19.

For printing through a solid color ribbon, the ribbon 22 may also be shifted by the ribbon guide 10 to a selected segment along its width such that printing can be effected across selected bands of the entire ribbon width rather than over just a narrow band of the ribbon.

The printer 12 also includes ribbon guide shifting means 36 for selectively shifting the ribbon guide 10 of the invention. The shifting means 36 includes a stepper motor 38 coupled through a drive gear 40 to the ribbon guide 10. As will hereinafter be more fully explained, rotation of drive gear 40 through a small angle of rotation rotates the ribbon guide 10 through a corresponding small angle to selectively shift and hold the position of the ribbon 22 with respect to the nosepeice 20 and printhead pins 19 of the printhead 14.

Figure 9:
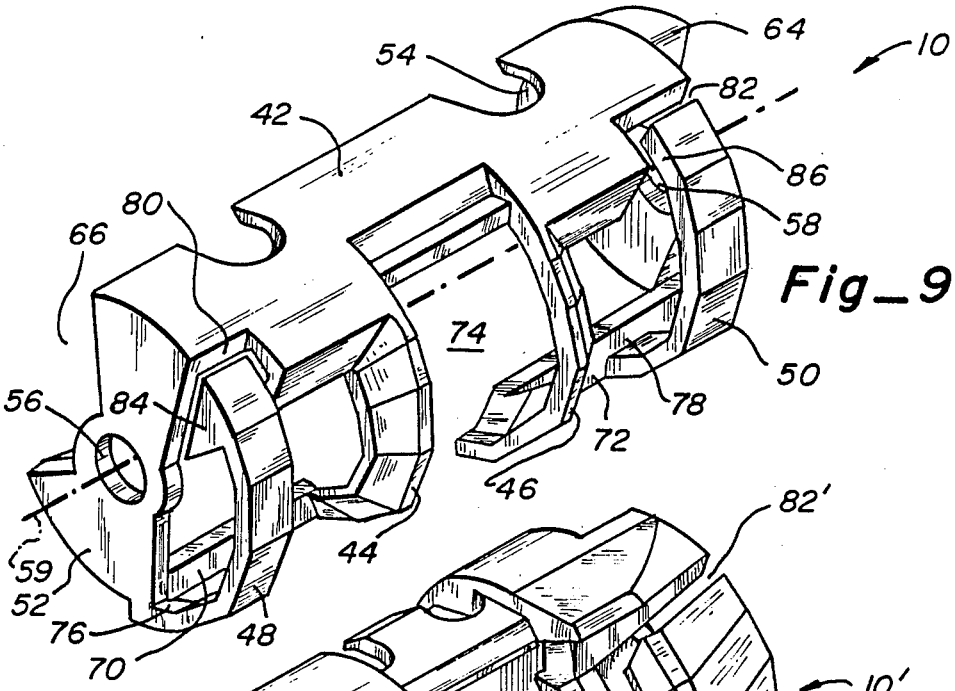
FIG. 9 is an enlarged perspective view of a ribbon guide constructed in accordance with a preferred embodiment of the invention.

Referring now to FIGS. 2-9 and as best seen in FIG. 9, the replaceable ribbon guide 10 is shown and includes, a central body portion 42, first support means for the ribbon 22 in the form of a faceted pair of ring segments 44, 46, and second support means for the ribbon in the form of a pair of faceted support members 48, 50. The ribbon guide 10 is preferably machined or molded as a unitary structure from a suitable material such as a synthetic resin. One such suitable material is Zytel, a glass reinforced nylon resin manufactured by DuPont.

The central body portion 42 is generally or partially cylindrical in shape and includes first end 52 and second end 54, each having a circular through hole 56, 58 coaxial to a longitudinal center line or axis 59 of the central body portion 42. The through holes 56, 58 function as a pivot means for pivotally mounting the ribbon guide 10 to pivot pins 60, 62 (FIG. 7) which are placed through the holes 56, 58 and attached to the nosepiece 20 of the printer 12. In addition to the through holes 56, 58, each end 52, 54 of the central body portion 42 has a sector 66, 68 (FIG. 4) of material removed from the ends 52, 54 respectively.

An arcuate segment of gear teeth 64 (FIG. 4) is formed adjacent to the second end 54 of the central body portion 42 as a drive means for coupling the ribbon guide 10 to the drive gear 40 of the shifting means of the printer 12. The arcuate segment of gear teeth 64 is located adjacent a portion of the outer periphery of the second end 54 of the central body portion 42. The gear teeth 64 extend laterally outward from the second end 54 a distance approximately equal to the width of the drive gear 40 and are perpendicular to the plane of the second end 54.

The faceted ring segments 44, 46 for supporting the ribbon 22 adjacent to the end of the nosepiece 22 are arcuate in shape and chamfered on an outside surface. The ring segments 44, 46 are formed directly on the central body portion 42 at a first end portion and are attached to side struts 70, 72 that extend inward from the ends 52, 54 respectively of the central body portion 42 at a second end portion. The ring segments 44, 46 have an arc length that is approximately equal to the width of the ribbon and are spaced apart from one another at a distance that is approximately equal to but slightly greater than the width of the nosepiece 20 of the printer 12.

Figure 7:
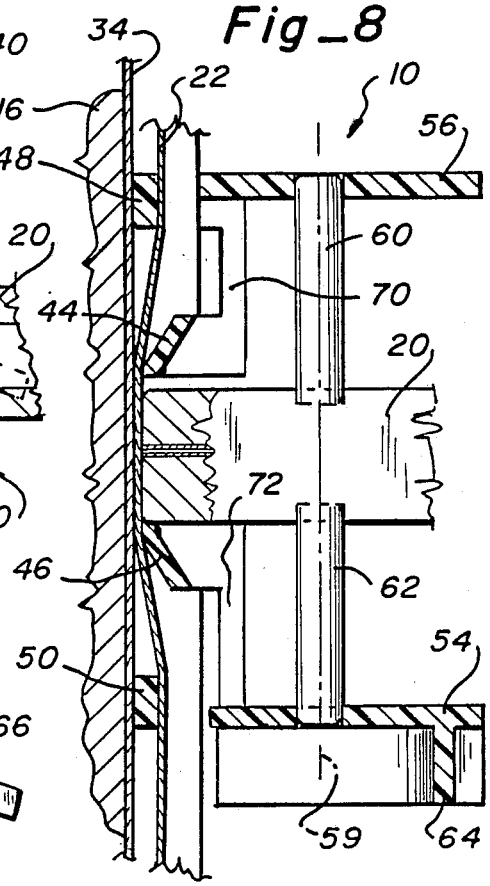
FIG. 7 is an enlarged horizontal cross sectional view taken along section line 7—7 of FIG. 2.

The construction and spacing of the ring segments 4, 46 forms an opening 74 through which the end of the nosepiece 20 and in particular the printhead pins 19 can project onto the ribbon 22, to imprint the web of paper 34. In addition as shown in FIG. 7 each ring segment 44, 46 is chamfered outwardly towards an end 54 or 56 respectively of the central body and downwardly towards a longitudinal axis 59 of the ribbon for supporting four different segments along the width of the ribbon 22. With this arrangement the ribbon guide 10 can be shifted to four different positions for printing four different segments on the ribbon. Alternately the ring segments 44, 46 may be faceted with a lesser or a greater number of flat segments which correspond to the number of positions for shifting the ribbon guide 10. A ring segment 44, 46 with four facets as disclosed would be suitable for use with a four color ribbon.

The support members 48, 50 of the ribbon guide 10 are also formed as arcuate ring segments generally annular in shape and have faceted outer and inner surfaces that correspond in size and shape to the faceted surface of the ring segments 44, 46. The support members 48, 50 are formed on the outside edge of the first 52 and second 54 ends respectively of the central body portion 42. The support members 48, 50 are attached to the central body portion 42 at an attachment end 76, 78 located along the periphery of the ends 52, 54 of the central body portion 42. The opposite ends of the support members 48, 50 are unattached and terminate at slits 80, 82 located through the support members 48, 50. The slits 80, 82 separate the unattached ends of the support members 48, 50 from the central body portion 42.

As clearly shown in FIG. 7, this arrangement permits the ribbon 22 to be threaded through the slits 80, 82 over the faceted ring segments 44, 46 and across opening 74 of the ribbon guide. The ribbon 22 is thus supported by the faceted outside surface of the ring segments 44, 46 and by the inside surface of the support members 48, 50. Each support member 48, 50 is formed with an inwardly extending ear or hook portion 84, 86 at its unattached end to help releasably secure the ribbon 22 on the inside surface of the support members 48, 50 and inhibit movement of the ribbon 22 back through the slits 80, 82. As is apparent, even a continuous or endless loop of ribbon can be threaded through the ribbon guide 10 in this manner.

As shown in FIG. 1 during operation of the ribbon guide 10, the faceted segments of the support members 48, 50 press against the surface of the printing paper 34 and press the paper 34 against the printing platen 16. This helps to prevent excessive curvature of the paper in the printing area and distortion of the print.

In operation of the ribbon guide 10 the rotation of the drive gear 40 by the stepper motor 38 through a small angle rotates the gear teeth 64 and the ribbon guide 10 about the pivot pins 60, 62 and through a corresponding small angle about its longitudinal axis 59. The direction of motion of the drive gear 40 and gear teeth 64 are indicated by arrows in FIGS. 2 and 4. Selective rotation of the ribbon guide 10 to a select position displaces the ribbon 22 with respect to the printhead pins 19 which are stationary. The ribbon guide 10 can be held in the selected position by the stepper motor 38 while the printing pins 19 imprint through the ribbon 22 and print onto the paper 34. In the illustrative embodiment of the invention there are four such selected positions that may be selectively actuated. Each position corresponds to a segment or band across the width of the ribbon 34 and to one of the four faceted segments on the ring segments 44, 46 and on the support members 48, 50.

During operation of the ribbon guide 10 a flat segment of the faceted ring segments 44, 46 (FIG. 7) holds a segment of the ribbon 22 flat against the paper 34 and printing platen 15 such that it may be struck at a right angle by the printhead pins 19. Additionally, a corresponding flat segment of the faceted outer surface of the support members 48, 50 (FIG. 7) presses against the paper 34 and holds a segment of the paper 34 against the printing platen 15. Since flat rather than curved surfaces press against the ribbon 22 and paper 34 there is less distortion and curvature of the paper and print. As shown in FIG. 7 during this operation, the ribbon 22 is supported by the outer surface of the faceted ring segments 44, 46 and by the inside surface of the faceted support members 48, 50. The hook portions 84, 86 of the support members 48, 50 help to inhibit movement of the ribbon back out of the slits 80, 82.

For changing a ribbon guide 10 the ribbon 22 can be pulled through the slits 80, 82 in the support member 48, 50 and the ribbon guide 10 disengaged from the pivot pins 60, 62 of the printhead nosepiece 20. The ribbon 22 can likewise be releasably resecured through the slits 80, 82 to a replacement ribbon guide 10 which may be reattached to pivot pins 60, 62.

Figure 10:
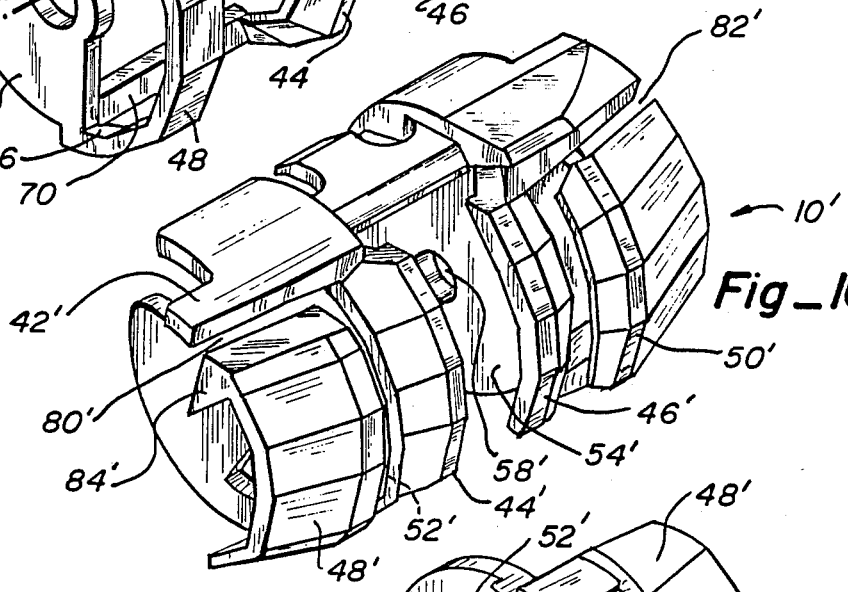
FIG. 10 is an enlarged perspective view of a ribbon guide constructed in accordance with an alternate embodiment of the invention.
Figure 11:
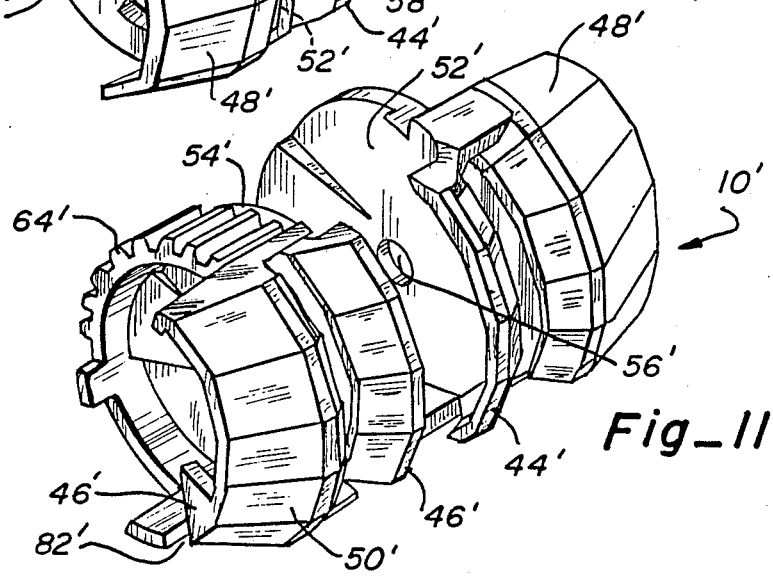
FIG. 11 is a perspective view of a ribbon guide constructed in accordance with the alternate embodiment of the invention shown from the opposite side.

Referring now to FIG. 10, an alternate embodiment of a ribbon guide constructed in accordance with the invention is shown and is designated as 10'. FIG. 11 represents an opposite side view of the alternate embodiment 10'.

In the alternate embodiment of the ribbon guide 10', the ends 52', 54' of the central body portion 42' are more closely spaced axially inward along the longitudinal axis of the central body portion 42'. This permits the ends 52', 54' of the ribbon guide 10' to be mounted to pivot pins to a nosepiece 20 of a printhead 14, with only a slight amount of clearance between the walls of the nosepiece 20 and the ends 52', 54' of the ribbon guide 10'. This is in contrast to the relatively large spacing as shown in FIG. 7 between the walls of the nosepiece 20 and the ends 52, 54 of the ribbon guide 10 in the preferred embodiment of the invention. This type of mounting may be desirable in some situations and for some types of printers.

In the alternate embodiment, pairs of ring segments 44', 46' and support members 48', 50' are again formed with faceted outer surfaces. The support members 48', 50' however have a greater width to compensate for the clsoer spacing of the ends 52', 54' and extend axially outward from the ends 52', 54' of the central body portion 42'. In addition the support members 48', 50' have a generally conical or truncated conical shape and taper as shown in FIG. 10 towards a longitudinal center line of the central body portion 42'. As before the support members 48', 50' have slits 80', 82' for threading the ribbon 22 into the ribbon guide 10'.

In general, the alternate embodiment of the ribbon guide 10' functions in the same manner as previously described for the preferred embodiment of the ribbon guide 10.

From the foregoing, the advantages of this invention are readily apparent The invention provides a ribbon guide in which an endless loop of ribbon can be releasably secured to or removed from the guide without breaking the ribbon. Also, the ribbon guide is formed with flat faceted surfaces for contact with the ribbon and printing paper such that the print can be struck with less distortion.

The invention has been described in detail with particular reference to a preferred embodiment thereof, but it will be understood that variations and modifications can be effected within the spirit and scope of the invention.

We claim:

1. A replaceable ribbon guide pivotally mounted on pivot pins extending from opposite sides of a dot matrix printhead which is traversable along a path parallel to a platen and including means for selectively shifting said ribbon guide to any one of selected number of positions about the pivot pins, said ribbon guide comprising:

a central body portion having first and second ends;

pivot means formed at each of said first and second ends for pivotally mounting said ribbon guide on the pivot pins;

a spaced pair of faceted ring segments adjacent and spaced inward from said ends, respectively of said body portion to support a ribbon so that it is formed into flat segments as it passes through said ribbon guide to bring one of the ribbon segments along the width of the ribbon into parallel relationship with said print head so that a select ribbon segment will be struck at a right angle by the printhead;

annular support members, having a faceted outer surface, spaced outwardly, respectively, from each of said ring segments; and a slit in each of said support members through which the ribbon can be passed for releasably securing it to said ribbon guide.

2. Apparatus, as claimed in claim 1, wherein;

said annular support members are a second pair of ring segments.

3. Apparatus, as claimed in claim 1, wherein both of said ring segments are chamfered at an outer edge.

4. Apparatus, as claimed in claim 3, wherein;

both of said annular support members are in the form of a truncated cone sloping inwardly in the direction away from said central body portion.

5. Apparatus, as claimed in claim 1, wherein;

said annular support members each have an unattached end part; and said slits are each at one of said unattached ends of each of said annular support members.

6. Apparatus, as claimed in claim 5, further including:

an inwardly extending hook portion at said one unattached end of each of said support members to inhibit movement of the ribbon back out of said slit after it is in place.

7. A replaceable ribbon guide for a dot matrix printer having a printhead and a ribbon for printing on a paper, with the printhead traversable along a path parallel to a printing platen and with the printer having shifting means for selectively shifting said ribbon guide to any one of a selected number of positions, said ribbon guide comprising:

a central body portion having a first end and a second end and an opening for an end of the printhead;

pivot means for pivotally attaching said ribbon guide to the printhead in engagement with the shifting means;

a first pair of support means on said central body portion located on either side of said opening in said central body portion for supporting the ribbon across said opening and having a faceted outer surface with a plurality of flat segments for forming a selected portion along the width of the ribbon into a flat segment such that the printhead will strike the supported ribbon portion at approximately a right angle;

a second pair of support means spaced at opposite ends of said central body portion respectively and having a faceted outer surface with a plurality of flat surfaces for pressing a selected portion of the paper against the printing platen;

a slit in each of said second support means through which the ribbon can be passed and releasably secured to said ribbon guide; and drive means for coupling said central body portion to the shifting means of the printer.

8. Apparatus, as claimed in claim 7, wherein;

said first pair of support means are arcuate ring segments attached at each end to said central body.

9. Apparatus, as claimed in claim 8, wherein;

said second pair of support means are arcuate ring segments attached at one end to said central body and unattached at an opposite end adjacent to said slits.

10. Apparatus, as claimed in claim 9, wherein;

said second pair of arcuate ring segments are formed with a downwardly extending hook portion at said unattached end to inhibit movement of the ribbon out of said slits.

11. Apparatus, as claimed in claim 10 wherein;

said pivot means comprises through holes in said first and second ends for mounting the ribbon guide to pivot pins attached to the printhead.

12. Apparatus, as claimed in claim 11 wherein;

said drive means comprises an arcuate gear segment formed on said central body portion.

13. A dot matrix printer having a printhead and a ribbon for printing a web of paper with the printhead traversable along a path parallel to a printing platen and with the printer having shifting means for selectively shifting a ribbon guide to anyone of a selected number of positions, a replaceable ribbon guide comprising;

a central body portion having a first end and a second end, each of said end shaving a through hole for pivotally mounting said ribbon guide for rotation about its central axis on pivot pins attached to the printhead;

a pair of arcuate ring segments formed on said central body portion to support the ribbon adjacent to an end of the printhead with each of said ring segments having a faceted outer surface with a plurality of flat segments for forming a selected segment along the width of the ribbon into a flat segment such that the printhead will strike the ribbon portion at approximately a right angle;

a pair of arcuate support members formed at either end of said central body portion with each of said support members attached at a first end of each of said support members to said central body portion and unattached at an opposite end of each of said support members, each of said support members being formed with a faceted outer surface for pressing a selected segment of the paper against the printing platen;

slits in each of said arcuate support members adjacent said unattached ends through which the ribbon can be passed and releasably secured to said ribbon guide;

an arcuate gear segment formed on said central body portion for coupling said ribbon guide to the shifting means of the printer; and a hook portion formed on a bottom surface of each of said arcuate support members adjacent to said unattached end to inhibit movement of the ribbon out of said slits.

14. Apparatus, as claimed in claim 13, wherein;

said faceted surfaces of said ring segments and said support members include four flat segments.

15. Apparatus, as claimed in claim 14, wherein;

each of said arcuate ring segments is chamfered along an outside edge.

16. Apparatus, as claimed in claim 15, wherein;

each of said arcuate ring segments is formed with an arc length approximately equal to the width of the ribbon.

* * * * *